US005122194A

United States Patent [19]

Miller et al.

[11] Patent Number: 5,122,194

[45] Date of Patent: Jun. 16, 1992

[54] METHODS AND COMPOSITIONS FOR REMOVING POLYCHLORINATED BIPHENYLS FROM A CONTAMINATED SURFACE

[75] Inventors: Melvin N. Miller, Bellevue; Thomas J. Rucker, Vancouver, both of Wash.

[73] Assignee: Burlington Environmental Inc., Seattle, Wash.

[21] Appl. No.: 565,026

[22] Filed: Aug. 8, 1990

[51] Int. Cl.[5] ..... B08B 3/08; B08B 7/00; B08B 9/00; C11D 7/06

[52] U.S. Cl. ..... 134/29; 134/22.14; 134/40; 210/909; 252/158; 252/312; 252/351

[58] Field of Search ..... 252/312; 210/909; 134/22.14, 29, 40

[56] References Cited

U.S. PATENT DOCUMENTS

| | | | |
|---|---|---|---|
| 2,697,674 | 12/1954 | Eisen | 252/312 X |
| 3,239,467 | 3/1966 | Lipinski | 134/40 X |
| 3,551,204 | 12/1970 | Bolger et al. | 134/40 X |
| 4,349,448 | 9/1982 | Steele | 134/40 X |
| 4,351,978 | 9/1982 | Hatano et al. | 210/909 X |
| 4,353,793 | 10/1982 | Brunelle | 208/262.5 |
| 4,405,448 | 9/1983 | Googin et al. | 210/909 X |
| 4,430,208 | 2/1984 | Pytlewski et al. | 210/909 X |
| 4,483,717 | 11/1984 | Olmsted et al. | 134/12 |
| 4,610,729 | 9/1986 | Keane | 134/25.1 |
| 4,792,413 | 12/1988 | Nash et al. | 252/111 |
| 4,832,833 | 5/1989 | Keane | 208/391 X |
| 4,844,745 | 7/1989 | Nash et al. | 134/42 |
| 4,869,825 | 9/1989 | Steiner | 134/12 X |
| 4,921,628 | 5/1990 | Nash et al. | 252/111 |

FOREIGN PATENT DOCUMENTS

| | | |
|---|---|---|
| 2632540 | 6/1988 | France . |
| 2049722A | 12/1980 | United Kingdom . |
| 2100746A | 1/1983 | United Kingdom . |

OTHER PUBLICATIONS

Chemical Abstracts 102:134015s (N. Honma).

*Primary Examiner*—Richard D. Lovering
*Attorney, Agent, or Firm*—Seed and Berry

[57] ABSTRACT

A method and compositions for removal of polychlorinated biphenyls (PCBs) from a surface by treatment of the surface with an extraction solvent, and encapsulating solution and an aqueous wash are disclosed. The extraction solvent includes a mixture of kerosene and a surfactant. The encapsulating solution includes a mixture of a metal hydroxide, a solvent dispersion agent, a coupling agent and water.

22 Claims, No Drawings

METHODS AND COMPOSITIONS FOR REMOVING POLYCHLORINATED BIPHENYLS FROM A CONTAMINATED SURFACE

TECHNICAL FIELD

The present invention relates generally to methods and compositions for removal of polychlorinated biphenyls (PCBs) from a surface, and, more specifically, to the removal of PCBs from a surface by treatment with an extraction solvent, an aqueous encapsulating solution and an aqueous wash.

BACKGROUND OF THE INVENTION

Polychlorinated biphenyls (PCBs) were once a widely used industrial chemical employed as an insulation fluid in electrical capacitors, electrical transformers, vacuum pumps, gas-transmission turbines and a variety of other devices and products. Their high stability contributed to both their commercial usefulness and, as recognized more recently, in their long-term deleterious environmental and health effects. Due to their wide industrial use, contamination of surfaces with PCBs is confronted in a variety of settings. For example, industries which employ compressed air piping and vessel networks often confront PCB contamination due to the presence of PCBs in oil which has leaked into, and transported through, the air piping of vessel network.

PCBs are presently listed as carcinogens by the Environmental Protection Agency (EPA). Due to governmental regulation of PCBs, there is a need for effective removal of PCBs from contaminated surfaces. A technique used previously to remove PCBs from contaminated surfaces involves washing the surface with kerosene. Such treatment, however, has met with only limited success due to its minimal PCB extraction efficiency. Moreover, following treatment with kerosene, a subsequent water rinse of the surface is ineffectiveness due to the lack of solubility of kerosene in water, thus resulting in residual kerosene remaining upon the treated surface.

Accordingly, there is a need in the art for methods and compositions for removing PCBs from contaminated surfaces. The present invention provides such methods and compositions, and further provides other related advantages.

SUMMARY OF THE INVENTION

Briefly, stated, the present invention provides a method for the removal of PCBs from a contaminated surface. The method includes the following steps: first, the surface is treated with an extraction solvent to remove PCBs from the contaminated surface and yield a PCB-laden extraction solvent; second, the surface is treated with an aqueous encapsulating solution under turbulent flow conditions to remove residual PCB-laden extraction solvent from the treated surface; and third, the surface is washed with water to remove any residual aqueous encapsulating solution which may remain on the surface or has deposited on the surface in the form of salts.

The present invention also discloses compositions for use in the removal of PCBs from a contaminated surface. The compositions include an extraction solvent and an aqueous encapsulating solution.

The extraction solvent comprises a mixture of kerosene and a surfactant. The surfactant of the extraction solvent is preferably a nonionic nonylphenol or octylphenol having a hydrophylic-lipophylic balance ("HLB") value ranging from about 6 to about 10. In another embodiment of the present invention, the extraction solvent further includes an aqueous metal hydroxide solution.

The encapsulating solution comprises a mixture of a metal hydroxide, a solvent dispersion agent, a coupling agent and water. Preferably, the metal hydroxide is sodium or potassium hydroxide, the solvent dispersion agent is 2-butoxyethanol or 2-(2-butoxyethoxy) ethanol, and the coupling agent is a nonionic nonylphenol or octylphenol having a HLB value ranging from about 17 to about 23.

Other aspects of the present invention will become evident upon reference to the following detailed description.

DETAILED DESCRIPTION OF THE INVENTION

The present invention is directed to a method for removing PCBs from a contaminated surface. Within one aspect, the method includes the following steps in the order specified. First, the surface is treated with an extraction solvent to remove PCBs from the contaminated surface and yield a PCB-laden extraction solvent, the surfactant having an HLB value ranging from about 6 to about 10. Second, the surface is treated with an aqueous encapsulating solution under turbulent flow conditions to remove residual PCB-laden extraction solvent from the treated surface. The aqueous encapsulating solution is capable of encapsulating the residual PCB-laden extraction solvent, thereby permitting phase separation of the PCB-laden extraction solvent and aqueous encapsulating solution upon settling. Third, the surface is washed with water to remove any residual aqueous encapsulating solution which may remain on the surface or has deposited on the surface in the form of salts.

As noted above, the extraction solvent includes a mixture of kerosene and a surfactant. The surfactant is added to the kerosene in an amount sufficient to increase the miscibility of PCBs in the kerosene. Thus, the extraction solvent serves to dissolve or extract the contaminating PCBs upon the surface into the kerosene, yielding a PCB-laden kerosene.

Preferably, the surfactant of the extraction solvent is a nonionic nonlyphenol of the following general formula:

$$CH_3(CH_2)_8—C_6H_4—O—(CH_2CH_2O)_n—H,$$

wherein n averages 4. In another embodiment of the present invention, the surfactant of the extraction solvent is a nonionic octylphenol of the following general formula:

$$CH_3(CH_2)_7—C_6H_4—O—(CH_2CH_2O)_n—H,$$

wherein n averages 4. Such surfactants may be characterized as "N-molar nonionic nonylphenols" or "N-molar nonionic octylphenols" were N is the number of ethylene oxide moieties in the surfactant chain and typically ranges from about 3 to 6.

Alternatively, such surfactants may be characterized by their HLB value, defined as follows:

$$(\text{Molecular Weight Ethylene Oxide}) \times (\text{Moles Ethylene Oxide}) \div 30 \div \text{HLB}$$

Thus, a nonionic nonylphenol or octyphenol which averages 4 molar will have a HLB value of approximately 6 to 10.

Preferred extraction solvent surfactants of the present invention are nonionic nonylphenol and nonionic octylphenol having a HLB value ranging from about 6 to about 10. Examples of such surfactants are sold under the name of Makon 4 and Makon 6 (Stepan Chemical Company, Northfield, Ill.) and Triton X70 (Rohm & Haas Company, Philadelphia, Pa.).

As noted above, the surfactant is present in the kerosene in an amount sufficient to increase the miscibility of PCBs in the kerosene in order to extract the PCBs from the contaminated surface. For example, with a nonionic nonylphenol or octylphenol having a HLB value ranging from about 6 to about 10, a surfactant concentration of from about 1,000 ppm to about 10,000 ppm is preferred, and about 5,000 ppm is most preferred.

PCB contaminated pipes and vessels will vary in their specific characteristics due to the various types of oils which may be present on the contaminated surface. If high viscosity oils or greases are encountered upon the surface, it may be necessary to increase the surfactant concentration of the extraction solvent to the higher end of its preferred concentration range, for example 10,000 ppm, to achieve greater miscibility of the PCBs in the kerosene.

While not essential, the extraction solvent is preferably applied under high shear conditions, rather than laminar flow, to provide scrubbing action and full coverage of the surface being treated. For example, when the surface being treated is the interior surface of a vessel, a 360 degree, high pressure rotating nozzle with fluid driven rotation is preferably used in this step. If the surface being treated is the interior of a tall vessel, the nozzle height within the vessel may be adjusted to achieve adequate coverage to all interior surfaces. The high-shear scrubbing action of the nozzle assists in removing scale and particulate matter which may contain PCB contamination. Particles dislodged during such scrubbing may be removed from the extraction solvent using bag filters of 25 to 100 microns. Application of the extraction solvent under high shear conditions also aids extraction of PCB from pits and crevasses upon the face of the surface being treated.

The spent extraction solvent (i.e., the PCB-laden kerosene) may be recovered and reused until it reaches a commercially advisable upper PCB concentration limit, typically 2,000 ppm. Thus, following treatment of a surface with the extraction solvent, if the extraction solvent contains less than the upper PCB concentration of 2,000 ppm, the extraction solvent may be used in the treatment of another contaminated surface. Once the upper PCB concentration limit is reached (or at any point prior to reaching the upper limit), the extraction solvent may be disposed of by incineration.

In another embodiment of the present invention, the extraction solvent further includes an aqueous metal hydroxide solution. Preferably sodium hydroxide is used, although other metal hydroxides may be employed. If residual water is present upon the contaminated surface being treated with the extraction solvent, the surfactant in the extraction solvent may react with the residual water to cause the extraction solvent to turn into a thick, pasty mixture. This condition can be corrected by adding an aqueous solution of a metal hydroxide to the extraction solvent. Circulation of the extraction solvent in the presence of the metal hydroxide solution will maintain the extraction solvent as a low viscosity fluid. Following treatment of the contaminated surface, the spent extraction solvent may be separated from the metal hydroxide solution by phase separation of the aqueous and hydrocarbon layer formed upon settling.

The phrase "residual water present upon the contaminated surface" is used herein to means water which is present on the surface in an amount up to about 10% by volume of the vessel or container being cleaned. For example, if the interior surface of a pipe is being treated with the extraction solvent, water may be present on the interior surface of the pipe in an amount up to 10%by volume of the pipe. If residual water is present upon the contaminated surface, the aqueous metal hydroxide solution may be added to the extraction solvent in an amount ranging from about 1% to about 25% by weight of the extraction solvent, and preferably about 2% to about 10% by weight.

Following treatment of the surface with the extraction solvent, the surface is next treated with an aqueous encapsulating solution under turbulent flow conditions to remove any residual spent extraction solvent from the surface. This step of the treatment serves to extract any kerosene remaining on the surface by temporarily encapsulating the spent extraction solvent under turbulent flow conditions as a single phase component with the encapsulating solution. The phrase "turbulent flow conditions" is used herein to mean that the application of the encapsulating solution to the surface is sufficiently violent to yield a single phase extraction solvent-/encapsulating solution component. Such a condition may be achieved, for example, by a high pressure washer which distributes the encapsulating solvent upon the surface under turbulent conditions. Alternatively, a fluid-driven, rotating nozzle, as discussed above, may be employed. Application of the encapsulating solution under turbulent flow conditions also aids in degreasing and removing scale from the surface being treated.

Following treatment of the surface with the encapsulating solution, the single phase spent extraction solvent/encapsulating solution component may be recovered and allowed to settle in a separation vessel. Upon settling, the single phase component separates into a spent extraction solvent (i.e., hydrocarbon) phase and an encapsulating solution (i.e., aqueous) phase, thus permitting individual recovery of each component. The recovered spent extraction solvent (i.e., the PCB-laden kerosene) may be reused to disposed of in the manner discussed above. The recovered encapsulating solution may similarly be reused or disposed of by, for example, incineration.

The encapsulating solution of the present invention forms a colloidal mixture which is effective in encapsulating kerosene under turbulent flow conditions and, as noted above, comprises a metal hydroxide, a solvent dispersion agent, a coupling agent, and water.

The metal hydroxide serves to increase the pH of the encapsulating solution to a value of about 10 or greater, preferably about 10–12, thus improving the ability of the encapsulating solvent to degrease the surface being treated. Preferably, the metal hydroxide is either sodium hydroxide or potassium hydroxide, although other metal hydroxides may be employed. Care should be taken, however, when choosing the metal hydroxide. For example, if the surface to be treated is aluminum, sodium hydroxide should be sued rather than potassium hydroxide because of the greater corrosive effect of potassium hydroxide on aluminum.

The metal hydroxide should be present in the encapsulating solution at a concentration ranging from about 1% to about 3% by weight, and preferably in the range of from about 1½% to about 2% by weight. One of ordinary skill in the art will recognize that the concentration of metal hydroxide may vary within this range depending upon the types of oils or greases encountered upon the surface to be treated. For example, if synthetic based oils are present on the contaminated surface, they will tend to interact with the PCBs extracted from the surface by the extraction solvent, and redeposit on the surface if not removed by the encapsulating solution. By increasing the hydroxide concentration of the the encapsulating solution to approximately 3% by weight, the synthetic oils are more readily encapsulated by the encapsulating solution.

The solution dispersion agent of the encapsulating solution serves to enhance degreasing of the surface due to its solubility in both water and oil. The solvent dispersion agents of the present invention are represented by the following general formula:

$$R_1—O—R_2—O—R_3$$

wherein $R_1$ is —H or $—CH_2CH_2OH$ $R_2$ is $—CH_2CH_2—$ or $—CH_2CH_2CH_2—$ and $R_3$ is $—C_nH_{(2n+1)}$ where n+3—6

Preferably, the dispersion agent is 2-butoxyethanol, commonly called BUTYL CELLOSOLVE® (i.e., when $R_1$ is —H, $R_2$ is $—CH_2CH_2—$, and $R_3$ is $—c_4H_9$), or 2-(2-butoxyethoxy)ethanol, commonly called BUTYL CARBITOL® (i.e., when $R_1$ is $—CH_2CH_2OH$, $R_2$ is $—CH_2CH_2—$, and $R_3$ is $—C_4H_9$).

The dispersion agent is generally present in the encapsulating solution at a concentration ranging from about 5,000 ppm to about 20,000 ppm, and preferably from about 7,500 ppm to about 10,000 ppm. The dispersion agents of the present invention, however, are not readily miscible in water at the pH of the encapsulating solution, and thus a coupling agent is required.

Preferably, the coupling agent of the encapsulating solution is a nonionic nonylphenol or a nonionic octylphenol having a HLB value ranging from about 17 to about 23, or commonly referred to as an 8 to 10.5 molar nonionic nonylphenol or octylphenol. Such compounds are sold under the name Tergitol 9.5 (Union Carbide Corporation, New York, N.Y.), Shell NP-9 (Shell Oil Company, Houston, Tex.), and Triton X100 (Rohm & Haas Company, Philadelphia, Pa.).

Sufficient coupling agent should be added to the encapsulating solution to permit the solvent dispersion agent to remain miscible in the metal hydroxide-containing encapsulating solution. In addition, the coupling agent serves as a wetting agent, penetration enhancer, solubilizing agent and dispersant, as well as an encapsulator with characteristics that allow for rapid deencapsulation of the hydrocarbon phase upon settling. The concentration of the coupling agent of the encapsulating solution may range from about 4,000 ppm to about 10,000 ppm, and preferably from about 5,000 ppm to about 7,500 ppm.

Following treatment of the surface with the encapsulating solution, the surface is washed with water to remove any residual encapsulating solution which may remain on the surface or has deposited on the surface in the form of salts. Preferably, the water is applied to the surface under high shear conditions. The recovered water may be recycled by, for example, distillation or evaporation, or it may be disposed of by, for example, incineration.

The following Examples are offered by way of illustration and not by way of limitation.

EXAMPLE 1

Mineral oil containing PCBs at a concentration of 5,000 ppm was washed through the interior of a 12 inch length of ½ inch interior diameter new carbon steel pipe. Complete coverage of the interior surface of the pipe was ensured by rotating the pipe during the application of the PCB-containing mineral oil.

In an initial series of experiments, kerosene was used in place of the extraction solvent of the present invention. Using a standard squirt bottle, the pipe was rinsed with 200 mL of kerosene. The pipe was rotated to ensure complete surface coverage by the kerosene. The pipe was then rinsed with 200 mL of an aqueous encapsulating solution containing 1% by weight NaOH, 5,000 ppm BUTYL CELLOSOLVE®, and 5,000 ppm nonionic nonylphenol having an HLB value of 20. The encapsulating solution was applied under turbulent flow conditions to yield a single phase kerosene/encapsulating solution component. Following treatment with the encapsulating solution, the pipe was rinsed with 200 mL of water. The pipe was rotated during these steps to ensure complete coverage.

The pipe was then allowed to air dry for approximately 30 minutes, and the interior surface triple rinsed with 100 mL of hexane to remove any residual PCB remaining upon the interior surface of the pipe following the above treatment. During hexane rinsing, the pipe was rotated to ensure complete interior surface coverage. The hexane rinsate was then tested for PCBs. The test was performed using the procedures of EPA document SW846 and EPA method 8080 (both of which are incorporated herein by reference) at medium level CLP, with minimum detection limit of 1 ppm.

This test found PCB within the hexane rinsate at a concentration of 11.9 ppm, which, when compared to the surface area of the interior of the pipe, is equivalent to PCB contamination of 1,050 $\mu g/cm_2$ upon the interior surface of the pipe. The test was then repeated upon a new section of pipe, resulting in 13.6 ppm of PCB in the hexane rinsate, which is equivalent to 1200 $\mu g/cm^2$ upon the interior surface of the pipe.

A series of tests were then performed which utilized the extraction solvent of the present invention in combination with the encapsulating solution and water rinse. A new length of 12 inch by ½ inch interior diameter carbon steel pipe was washed with mineral oil containing 5,000 ppm PCBs. Complete coverage of the interior surface of the pipe was ensured by rotating the pipe during the application of the PCB-containing solution.

Using a standard squirt bottle, the pipe was rinsed with 200 mL of extraction solvent. The extraction solvent contained kerosene and 5,000 ppm of nonionic nonylphenol having an HLB value of 9. The pipe was rotated to ensure complete surface coverage by the extraction solvent.

The pipe was then rinsed with 200 mL of an aqueous encapsulating solution containing 1% by weight NaOH, 5,000 ppm BUTYL CELLOSOLVE®, and 5,000 ppm nonionic nonylphenol having an HLB value of 20. The encapsulating solution was applied under turbulent flow conditions to yield a single phase extraction solvent/encapsulating solution component which was washed out the end of the pipe. Following treatment with the encapsulating solution, the pipe was rinsed with 200 mL of water. The pipe was rotated during these steps to ensure complete coverage.

The pipe was then allowed to air dry for approximately 30 minutes, and the interior surface triple rinsed with 100 mL of hexane to remove any residual PCB remaining upon the interior surface of the pipe. During hexane rinsing, the pipe was rotated to ensure complete interior surface coverage. The hexane rinsate was then tested for PCBs following the EPA procedures and methods discussed above.

This test showed no detectable level of PCBs present in the hexane rinsate (i.e., less than 1 ppm PCB was present in the rinsate). The test was then repeated three additional times. Each of the tests yielded no detectable level of PCBs in the hexane rinsate.

EXAMPLE 2

This experiment demonstrates the removal of PCBs from the interior surface of a contaminated natural gas air line pipe that had been in commercial use for over 15 years. The pipe was 1 inch inner diameter, schedule 80 pipe, heavily corroded and coated internally with heavy greases. The pipe was cut into six pieces (designated samples A through F), each piece ranging in length from 12 to 18 inches. The level of PCB contamination on the interior of the pipe was determined using a swab sampling technique.

The swab sampling technique was evaluated under the guidelines set forth in EPA Document 560/8-86-017 entitled "Field Manual for Grid Sampling of PCB Spill Sites to Verify Cleanup" (incorporated herein by reference). Such guidelines employ a wiping scheme which provides a statistical confidence level of at least 95%. This confidence level relates to the frequency of occurrence for sampling to ensure compliance with the 100 $\mu g/100\ cm^2$ EPA cleanup standard and is generally used by EPA to design sampling schemes. A 95% confidence level is achieved with at least 10 wipe samples collected per batch of extraction solvent used. Generally, wipe samples are collected in each system tested (e.g., contaminated pipe, vessel, etc.) in every 100 $ft^2$ of surface area. With the average system, this rate of 1 sample/100 $ft^2$ is equal to 2 or more samples per system. In order for the 95% confidence level to be achieved, five or less systems should be decontaminated with one batch of extraction solvent to obtain at least 10 samples. If less than 10 samples are taken for the 1 sample/100 $ft^2$ sampling ratio to be met, then additional samples are collected in the set of systems to make up a total of 10 wipe samples collected per batch of extraction solvent used.

The interior of pipes A and B (initial PCB surface contamination level 8,100 $\mu g/100\ cm^2$ and 7,200 $\mu g/100\ cm^2$, respectively) were first washed with 200 mL of an extraction solvent containing kerosene and 5,000 ppm of nonionic nonylphenol having an HLB value of 9. Next, the interior was rinsed with 200 mL of an aqueous encapsulating solution containing 1% by weight NaOH, 5,000 ppm butyl cellosolve, and 5,000 ppm nonionic nonylphenol having an HLB value of 20. The rinsing of pipes A and B with the encapsulating solution was not under turbulent flow conditions. Lastly, the pipes were washed with 200 mL of water. The pipes were then wiped to determine the PCB contamination of the interior surface of the pipe as described above. The results were 150 $\mu/100\ cm^2$ for pipe A, and 232 $\mu/100\ cm^2$ for pipe B. Such levels are above the EPA $\mu g/100\ cm^2$ cleaning limit.

Pipes C and D were sampled by the wiping technique described above and found to have interior surface contamination of 6,500 $\mu g/100\ cm^2$ and 4,400 $\mu g/100\ cm^2$, respectively. The interior surfaces of both pipes were first treated under high shear conditions with an extraction solvent containing kerosene and 5,000 ppm of nonionic nonylphenol having an HLB value of 9. High shear conditions with the extraction solvent were achieved by plugging the end of the pipe with a stopper, filling the pipe approximately half full with the extraction solvent, plugging the opposite end of the pipe with a stopper, and agitating by shaking vigorously. This step was repeated three times until a total volume of 200 mL of extraction solvent had been utilized. The extraction solvent was then drained from the pipe.

The pipe was then treated with 200 mL of an aqueous encapsulating solution containing 1% by weight NaOH, 5,000 ppm BUTYL CELLOSOLVE ®, and 5,000 ppm nonionic nonylphenol having an HLB value of 20.The encapsulating solution was applied under turbulent flow conditions to yield a single phase extraction solvent/encapsulating solution component. Turbulent flow conditions were achieved by the same technique utilized for treatment with the extraction solvent. Lastly, the pipes were rinsed with 200 mL of water under high shear conditions. High shear conditions were achieved in the water rinse by the same technique utilized for treatment with the extraction solvent.

Pipes C and D were evaluated by the wiping technique described above and found to have interior surface PCB contamination of 18 $\mu g/cm^2$ and 32 $\mu g/cm^2$, respectively.

Pipes E and F were sampled by the wiping technique described above and found to have interior surface contamination of 7,500 $\mu g/100\ cm^2$ and 6300 $\mu g/100\ cm^2$, respectively. Pipes E and F were treated and tested following the same procedure set forth above for pipes C and D. Following treatment by the process of the present invention, Pipe E contained no detectable level of PCB, and pipe F contained 28 $\mu g/100\ cm^2$.

Pipes C, D, E and F demonstrated a single treatment removal efficiency by the present invention of greater than 99%. Treatment of the contaminated surface with the encapsulating solution in the absence of turbulent flow conditions failed to achieve interior surface levels below the acceptable EPA cleaning limits. The results of this series of experiments are summarized in the following Table.

TABLE

| PIPE SAMPLE | PRE-TREATMENT PCB CONTAMINATION ($\mu g/100\ cm^2$) | POST-TREATMENT PCB CONTAMINATION ($\mu g/100\ cm^2$) |
|---|---|---|
| A | 8,100 | 150 |
| B | 7,200 | 232 |
| C | 6,500 | 18 |
| D | 4,400 | 32 |
| E | 7,500 | <1 |
| F | 6,300 | 28 |

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A process for removing PCBs from a surface, comprising:

treating the surface with an extraction solvent comprising a mixture of kerosene and a surfactant, the surfactant being miscible in kerosene and serving to increase the miscibility of the PCBs in the kerosene and yield a PCB-laden extraction solvent, wherein the surfactant is a nonionic ethylene oxide condensate of nonylphenol or octylphenol and has an HLB value ranging from about 6 to about 10;

treating the surface previously treated with the extraction solvent with an aqueous encapsulating solution comprising a metal hydroxide, a solvent dispersion agent, a coupling agent and water, the encapsulating solution being applied under turbulent flow conditions to remove residual PCB-laden extraction solvent remaining on the surface, the aqueous encapsulating solution being capable of encapsulating the residual PCB-laden extraction solvent, thereby permitting phase separation of the PCB-laden extraction solvent and aqueous encapsulating solution upon settling, wherein the coupling agent is a nonionic ethylene oxide condensate of nonylphenol or octylphenol and has an HLB value ranging from about 17 to about 23, and wherein in the solvent dispersion agent has the formula $$R_1—O—R_2—O—R_3$$

wherein $R_1$ is —H or $—CH_2CH_2OH$, $R_2$ is $—CH_2CH_2—$ or $—CH_2CH_2CH_2—$, and $R_3$ is $C_nH_{(2n+1)}$ where n+3-6; and washing the treated surface with water to remove any residual aqueous encapsulating solution.

2. The process of claim 1 wherein the surfactant of the extraction solvent is a nonionic ethylene oxide condensate of nonylphenol.

3. The process of claim 1 wherein the surfactant of the extraction solvent is a nonionic ethylene oxide condensate of octylphenol.

4. The process of claim 1 wherein the surfactant of the extraction solvent is present at a concentration ranging from about 1,000 ppm to about 10,000 ppm.

5. The process of claim 1 wherein the step of treating the surface with the extraction solvent is performed under high shear conditions.

6. The process of claim 1 wherein the PCB concentration of the extraction solvent is below 2,000 ppm.

7. The process of claim 1 wherein the extraction solvent further includes an aqueous metal hydroxide solution.

8. The process of claim 7 wherein the metal hydroxide is sodium hydroxide.

9. The process of claim 7 wherein the concentration of the metal hydroxide ranges from about 1% to about 25% by weight of the extraction solvent.

10. The process of claim 7 wherein the concentration of the metal hydroxide ranges from about 2% to about 10% by weight of the extraction solvent.

11. The process of claim 1 wherein the metal hydroxide of the encapsulating solution is sodium hydroxide or potassium hydroxide.

12. The process of claim 1 wherein the metal hydroxide of the encapsulating solution is present at a concentration ranging from about 1% to 3% by weight.

13. The process of claim 1 wherein the metal hydroxide of the encapsulating solution is present at a concentration ranging from about 1½% to 2% by weight.

14. The process of claim 11 wherein $R_1$ is —H, $R_2$ is $—CH_2CH_2—$, and $R_3$ is $CH_2CH_2—$, and $R_3$ is $—C_4H_9$.

15. The process of claim 1 wherein $R_1$ is $—CH_2CH_2OH$, $R_2$ is $—CH_2CH_2—$, and $R_3$ is $—C_4H_9$.

16. The process of claim 1 wherein the solvent dispersion agent of the encapsulating solution is present at a concentration ranging from about 5,000 ppm to about 20,000 ppm.

17. The process of claim 1 wherein the solvent dispersion agent of the encapsulating solution is present at a concentration ranging from about 7,500 ppm to about 10,000 ppm.

18. The process of claim 1 wherein the coupling agent of the encapsulating solution is a nonionic ethylene oxide condensate of nonylphenol.

19. The process of claim 1 wherein the coupling agent of the encapsulating solution is a nonionic ethylene oxide condensate of octylphenol.

20. The process of claim 1 wherein the coupling agent of the encapsulating solution is present at a concentration ranging from about 4,000 ppm to about 10,000 ppm.

21. The process of claim 1 wherein the coupling agent of the encapsulating solution is present at a concentration ranging from about 5,000 ppm to about 7,500 ppm.

22. The process of claim 1 wherein the step of washing the treated surface with water to remove any residual aqueous encapsulating solution is performed under high shear conditions.

* * * * *

UNITED STATES PATENT AND TRADEMARK OFFICE

CERTIFICATE OF CORRECTION

PATENT NO. : 5,122,194

DATED : June 16, 1992

INVENTOR(S) : Melvin N. Miller et al.

It is certified that error appears in the above-indentified patent and that said Letters Patent is hereby corrected as shown below:

In column 9, claim 1, line 35, please delete "in".

In column 9, claim 1, line 42, please delete "n + 3-6" and substitute therefor -- n = 3-6 --.

In column 10, claim 14, line 26, please delete "claim 11" and substitute therefor -- claim 1 --.

In column 10, claim 14, line 27, please delete "and $R_3$ is $CH_2CH_2$-,"

Signed and Sealed this

Twenty-fourth Day of August, 1993

Bruce Lehman

*Attest:*

BRUCE LEHMAN

*Attesting Officer*

*Commissioner of Patents and Trademarks*